US005329895A

United States Patent [19]

Nishida et al.

[11] Patent Number: 5,329,895

[45] Date of Patent: Jul. 19, 1994

[54] SYSTEM FOR CONTROLLING VALVE SHIFT TIMING OF AN ENGINE

[75] Inventors: Masami Nishida; Toru Kurisu; Takashi Ikai; Hiroaki Sugiura; Hiroshi Enomoto; Masunori Kanda; Eiichi Yanagida; Hiroaki Deguchi; Masaki Fukuma; Akira Asai, all of Hiroshima, Japan

[73] Assignee: Mazda Motor Corporation, Hiroshima, Japan

[21] Appl. No.: 127,280

[22] Filed: Sep. 27, 1993

[30] Foreign Application Priority Data

Sep. 30, 1992 [JP] Japan ..... 4-262566
Jan. 29, 1993 [JP] Japan ..... 5-013101
Mar. 30, 1993 [JP] Japan ..... 5-071692

[51] Int. Cl.[5] ..... F01L 1/08
[52] U.S. Cl. ..... 123/90.17; 123/90.18
[58] Field of Search ..... 123/90.15, 90.16, 90.17, 123/90.18

[56] References Cited

U.S. PATENT DOCUMENTS 4,182,289 1/1980 Nakajima et al. ..... 123/90.18
4,352,344 10/1982 Aoyama et al. ..... 123/90.18
4,587,934 5/1986 Moores ..... 123/90.18
4,708,101 11/1987 Hara et al. ..... 123/90.18
5,012,773 5/1991 Akasaka et al. ..... 123/90.17
5,048,474 9/1991 Matayoshi et al. ..... 123/90.18
5,080,055 1/1992 Komatsu et al. ..... 123/90.18
5,129,407 7/1992 Phillips ..... 123/90.18

FOREIGN PATENT DOCUMENTS 2514727 10/1975 Fed. Rep. of Germany ... 123/90.18

*Primary Examiner*—E. Rollins Cross
*Assistant Examiner*—Weilun Lo
*Attorney, Agent, or Firm*—Fish & Richardson

[57] ABSTRACT

An intake valve or an exhaust valve is lifted through a swingable cam by the rotation of a rotatable cam formed in the cam shaft. A surface at which the swingable cam abuts with the rotatable cam is tapered in the axial direction in which said cam shaft extends, and the valve shift timing is changed by transferring the cam shaft, that is, the rotatable cam in the axial direction in which said cam shaft extends. The power transmitting member such as a helical gear to be rotated with the output shaft of the engine is engaged with the cam shaft through a helical spline. The power transmitting member is so arranged as to be unmovable in the axial direction in which said cam shaft extends. The rotational phase of the rotatable cam relative to the output shaft of the engine is changed by displacement of the cam shaft relative to the power transmitting member in the axial direction in which said cam shaft extends.

32 Claims, 13 Drawing Sheets

SYSTEM FOR CONTROLLING VALVE SHIFT TIMING OF AN ENGINE

BACKGROUND OF THE INVENTION

1. Field of the Invention

The present invention relates to a system for controlling a valve shift timing of an engine and, more particularly, to a system for controlling a valve shift timing of an engine, so adapted as to change the timing of opening or closing an intake valve or an exhaust valve in accordance with the running state of the engine.

2. Description of the Related Art

A system for controlling a valve shift timing of an engine is disclosed, for example, in Japanese Patent Unexamined Publication (kokai) Nos. 56-9,612, which comprises a rotatable cam arranged to rotate in synchronization with the rotation of the engine, a swingable cam disposed so as to be pivotally driven with the rotatable cam, and a locker arm arranged to lift a valve in association with the swingable cam. The surface of the rotatable cam with which the surface of the swingable cam is brought into contact is tapered in the direction of a rotational axis in which each of them rotates. Further, the valve-shift-timing control system has a drive means arranged so as to relatively move the swingable cam or the rotatable cam in its axial direction, thereby controlling changes of the valve shift timings by changing an initial phase of the swingable cam in accordance with the running state of the engine.

For such a conventional valve-shift-timing control system of the engine, the cam face of the swingable cam comprises an arc-shaped base section that does not lift the valve whatsoever and an arc-shaped lift section that lifts the valve in proportion to an amount of the pivotal movement of the swingable cam disposed adjacent to the arc-shaped base section. By relatively moving the swingable cam or the rotatable cam in its axial direction, the effective diameter of the rotatable cam varies to thereby change a valve lift amount, that is, a crank angle of the valve at which the valve is lifted or opened. In other words, in the state in which the swingable cam or the rotatable cam is relatively moved in its axial direction and the swingable cam is brought into contact with the larger diameter side of the rotatable cam, the effective diameter of the rotatable cam is increased and the swingable angle at which the swingable cam swings or pivots is increased to such an extent for the arc-shaped lift section to occupy all swingable angle. This arrangement provides the valve lift amount larger and the valve lift angle larger, at which the valve is lifted. On the other hand, in the state in which the swingable cam or the rotatable cam is relatively moved in its axial direction and the swingable cam is brought into contact with the shorter diameter side of the rotatable cam, the effective diameter of the rotatable cam is decreased and the swingable angle at which the swingable cam swings or pivots is decreased, thereby increasing the rate of the valve lift angle of the arc-shaped base section of the swingable cam relative to the entire valve lift angle of the swingable cam and increasing the valve lift amount. This arrangement makes the valve lift amount smaller and the valve lift angle smaller, at which the valve is lifted.

The conventional valve-shift-timing control system of the engine allows the valve lift amount and the valve lift angle to be adjusted on the basis of the relationship of the cam profile of the rotatable cam with the shape of the cam surface of the swingable cam; however, it is impossible to adjust the crank angle at which the valve is lifted to its maximal extent. In other words, the two valve lift characteristics can be gained in which the crank angles of the valve at which the valve reaches its maximal valve lift amount are the same, as shown in FIGS. 8(*c*) and 8(*d*); however, the two valve lift characteristics cannot be gained in which the crank angles thereof at which the valve reaches its maximal valve lift amount are different from each other, as shown in FIGS. 8(*a*) and 8(*b*). Hence, the conventional valve-shift-timing control system poses the problem that the extent of freedom is restricted in setting the valve characteristic.

Further, it is considered that the disposition of a means for making the shape of a cam surface of the swingable cam variable can offer two valve lift characteristics in which the crank angles at which the valve reaches its maximal valve lift amount are different from each other. However, the disposition of such a means makes the structure of the swingable cam complex, thereby leading to an increase in the inertia weight of the swingable cam and consequently decreasing the limit of rotation of the engine.

SUMMARY OF THE INVENTION

The object of the present invention is to provide a system for controlling a valve shift timing of an engine, which can solve the difficulties and disadvantages inherent in the conventional valve-shift-timing control systems as well as suppressing the structure of a swingable cam from becoming complex and improving the limit of the rotation of the engine and the extent of freedom on the basis of the simple structure of the swingable cam in setting the valve lift characteristic.

In order to achieve the object as described hereinabove, the present invention provides a system for controlling a valve shift timing of an engine, which comprises:

a cam shaft arranged so as to be rotatably driven by an output shaft of the engine;

a swingable cam disposed so as to be swingable for lifting an intake valve or an exhaust valve in accordance with a pivotal movement of said swingable cam upon direct or indirect abutment with said intake valve or said exhaust valve;

a rotatable cam disposed on said cam shaft so as to be rotatable integrally with said cam shaft and to move said swingable cam pivotally in accordance with rotation of said cam shaft;

a transfer means for transferring said rotatable cam in an axial direction in which said cam shaft extends; and a rotational phase changing means for changing a rotational phase of said rotatable cam relative to said output shaft in accordance with the movement of said rotatable cam by said transfer means;

wherein each of an abuttable surface of said swingable cam and an abuttable surface of said rotatable cam is of a shape tapered in the axial direction in which said cam shaft extends; and said rotational phase changing means is disposed on a portion other than said swingable cam.

With the arrangement as described hereinabove, the valve-shift-timing control system of the engine according to the present invention can change the valve shift timing, i.e. the valve lift amount and/or the valve lift angle, by transferring or moving the rotatable cam in the axial direction in which the cam shaft extends. Further, the crank angle at which the valve reaches its maximal valve lift amount can also be changed because the rotational phase of the rotatable cam relative to the output shaft of the engine can be changed in accordance with the movement of the rotatable cam in the axial direction in which the cam shaft extends. In addition, the arrangement of the valve-shift-timing control system according to the present invention can improve the limit of rotation of the engine because the reciprocating inertia mass of a power valve mechanism can be made smaller than the conventional valve-shift-timing control systems due to the fact that the rotational phase changing means is disposed on the portion other than the swingable cam.

Other objects, features and advantages of the present invention will become apparent in the course of the description of the preferred embodiments, which follows, with reference to the accompanying drawings.

BRIEF DESCRIPTION OF THE DRAWINGS

A description will be made of the first embodiment of the valve-shift-timing control system of the engine according to the present invention with reference to FIGS. 1 to 8.

DESCRIPTION OF THE PREFERRED EMBODIMENTS

The present invention will be described more in detail by way of examples with reference to the accompanying drawings.

Figure 1:
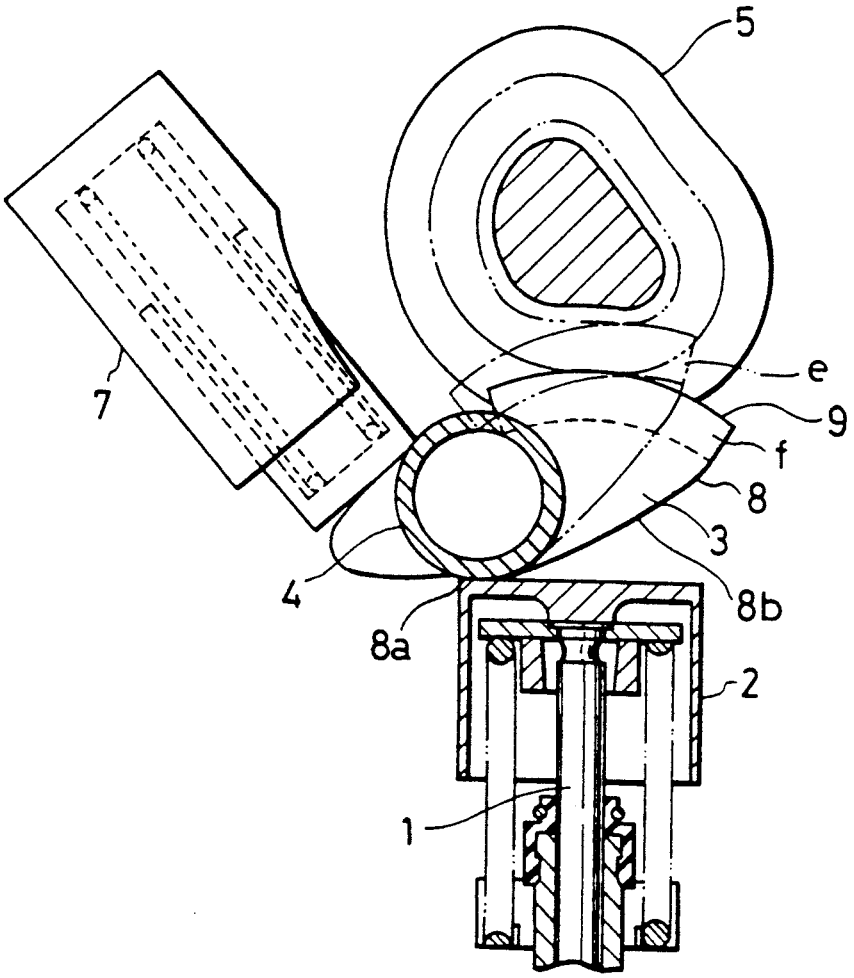
FIG. 1 is a partially sectional front view showing a valve-shift-timing control system of an engine according to a first embodiment of the present invention.
Figure 2A:
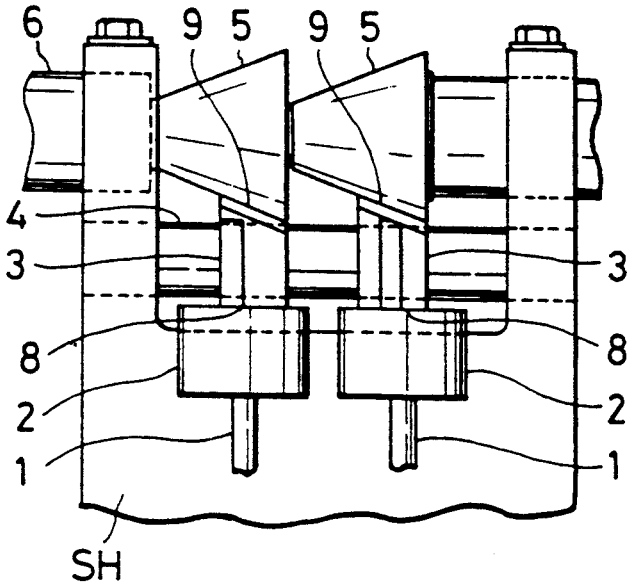
FIGS. 2(*a*) and 2(*b*) are each a side view showing the valve-shift-timing control system of FIG. 1.
Figure 2B:
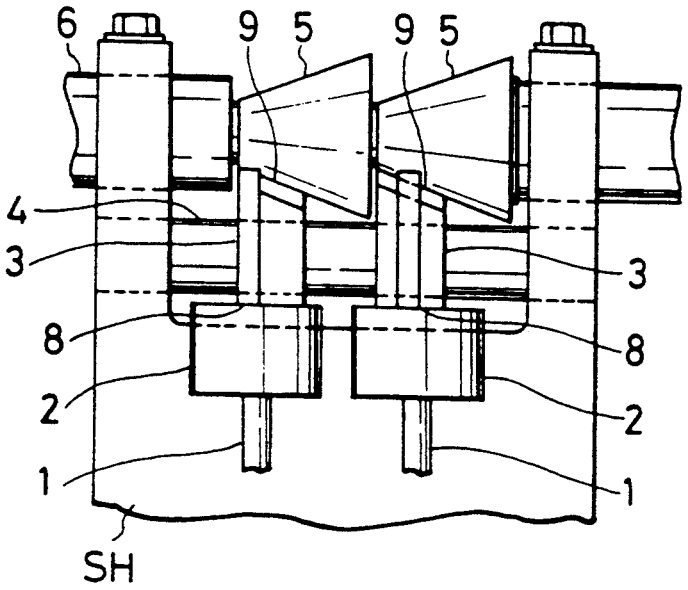
Figure 3A:
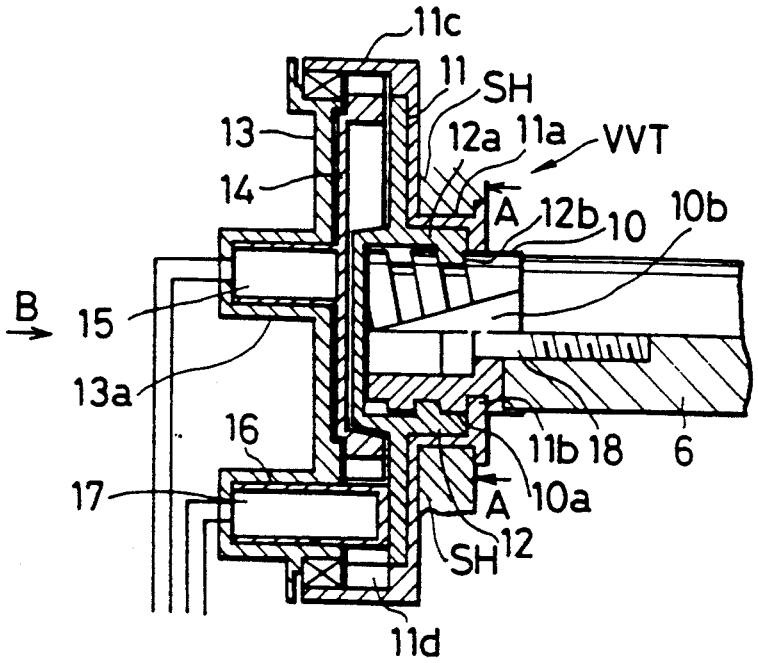
FIGS. 3(*a*) and 3(*b*) are each a sectional side view showing specific examples of a rotational phase changing means and a transfer means of the valve-shift-timing control system according to the present invention.
Figure 3B:
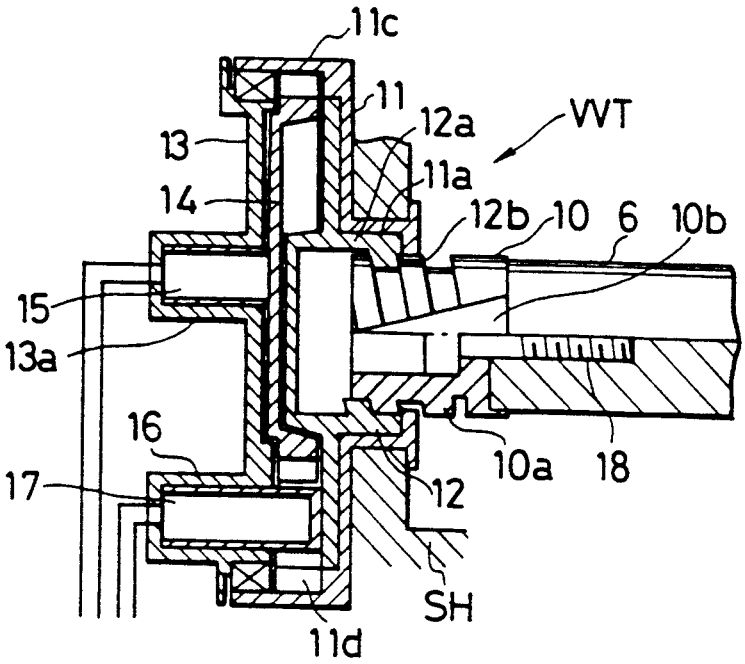

As shown in FIGS. 1 to 3, the valve-shift-timing control system of an engine according to the present invention comprises two valves, generally referred to as 1, for an intake system or for an exhaust system; a pair of left-hand and right-hand lash adjusters 2 and 2, or tappets, for opening or closing the valves 1 and 1; a pair of left-hand and right-hand swingable cams 3 and 3, disposed so as to be movable pivotally in a state in which they are in slidable contact with the lash adjusters 2 and 2 as well as to lift the valves 1 and 1 through the lash adjusters 2 and 2 upon its pivotal movement; a cam shaft 4 for rotatably holding the swingable cams 3 ad 3; a pair of left-hand and right-hand rotatable cams 5 and 5 for pivotally moving the swingable cams 3 and 3 in association with the rotation of the rotatable cams 5 and 5; a cam shaft 6 for holding the rotatable cams 5 and 5, which is rotatably held with a cylinder head SH as a body of the engine; and a biasing means 7 for biasing the swingable cams 3 and 3 toward the rotatable cams 5 and 5 to thereby allowing the rotatable cams 5 and 5 to abut always with the swingable cams 3 and 3, respectively.

The swingable cam 3 is formed in the shape of a wedge extending in its radial direction. The swingable cam 3 is biased with the biasing means 7 in such a manner that the slanting surface of the swingable cam 3 as a cam surface 8 abuts with the lash adjuster 2 and its rear surface 9, tapered at a given angle, slanting and extending in the axial direction of the cam shaft, is arranged so as to abut with the drive cam 5 tapered in a similar manner.

This arrangement allows the swingable cam 3 to receive the force biased by the biasing means about the cam shaft 4 so as to abut with and press toward the rotatable cam 5 and the cam surface 8 to change its position in contact with the lash adjuster 2 in accordance with a lift of the rotatable cam 5.

On the cam surface 8 of the swingable cam 3, there are provided an arc-shaped base section 8*a* and an arc-shaped lift section 8*b*. The arc-shaped base section 8*a* is of a circularly arc-shaped form, which does not lift the valve 1, that is, which does not open the intake inlet or the exhaust outlet, even if the swingable cam 3 abuts slidably with the lash adjuster 2 and eventually with the valve 1, and the arc-shaped lift section 8*b* is arranged to lift the valve 1, that is, to open the intake inlet or the exhaust outlet, when the swingable cam 3 abuts slidably with the valve 1. The valve lift angle of the valve and the valve lift amount thereof can be adjusted by setting the rate of the swingable angle occupied by the arc-shaped base section 8a or the swingable angle occupied by the arc-shaped lift section 8b relative to the entire swingable angle of the swingable cam 3 and the shape of the arc-shaped lift section 8b, on the basis of the relationship with the cam profile of the rotatable cam 5.

As shown in FIG. 3, the cam shaft 6 for holding the rotatable cams 5 and 5 is provided at its end portion with a valve-shift-timing variable mechanism VVT as a drive means for transferring the cam shaft in its axial direction and as a rotational phase changing means for making the rotational phase of the cam shaft 6 relative to a crank shaft, not shown, working as an output shaft of the engine.

A description will now be made of the valve-shift-timing variable mechanism VVT with reference to FIGS. 3 to 6.

Figure 5:
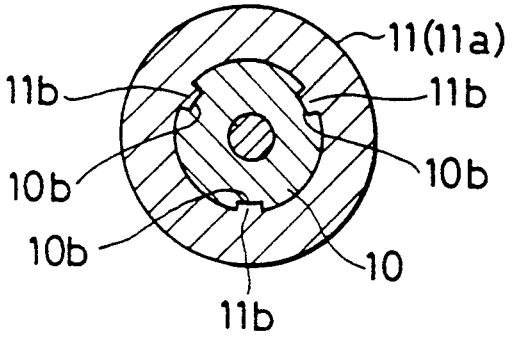
FIG. 5 is a sectional view showing an engagement portion at which a power transmitting member is engaged with a cam shaft through a helical spline.
Figure 6:
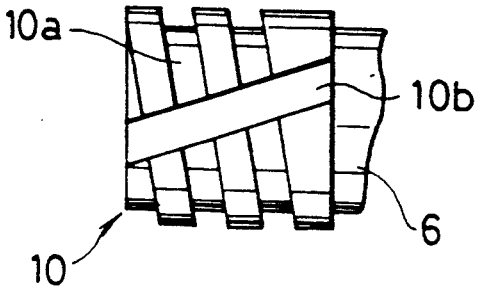
FIG. 6 is a side view showing an essential portion of a helical spline engagement of a gear section formed in the cam shaft with a helical spline.

To the surface at the end of the cam shaft 6, a thread member 10 with a square thread section 10a and a spline groove section 10b arranged at its outer circumference is fastened with a bolt 18, as shown in FIG. 6. The spline groove section 10b is arranged crossing with the square thread section 10a and disposed in an equally spaced relationship at three locations in the circumferential direction of the thread member. A cam pulley 11 working as a power transmitting means so arranged as to be associated with the crank shaft, now shown, is provided at its boss section 11a with three projections 11b (as shown in FIG. 5) so as to correspond to the three spline groove sections 10b, respectively, disposed in the thread member 10. The cam pulley 11 is held with the thread member 10 and the cam shaft 6 as a result of engagement of the three projections 11b with the respective three spline groove sections 10b. The spline groove section 10b is structured in such a manner that its one end portion side deviates from its other end portion side in its circumferential direction of the drive cam shaft 6, that is, that its one end portion side is arranged so as to extend in a slanting relationship relative to the axial line of the drive cam shaft 6 (in a helical spline manner), not to extend parallel thereto. The arrangement of the spline groove section 10b can change the rotational phase of the drive cam shaft 6 relative to the cam pulley 11 by transferring the projections 11b of the cam pulley 11 relative to and axially along the respective spline groove sections lob.

The boss section 11a of the cam pulley 11 is so arranged as to allow its inner surface to come into rotatable contact with an interconnection member 12 having a boss section 12a whose inner circumferential surface is provided with a thread section 12b that is disposed so as to be threaded with the square thread section 10a of the thread member 10. This arrangement allow an axial movement of the interconnection member 12 relative to the drive cam shaft 6.

Figure 4:
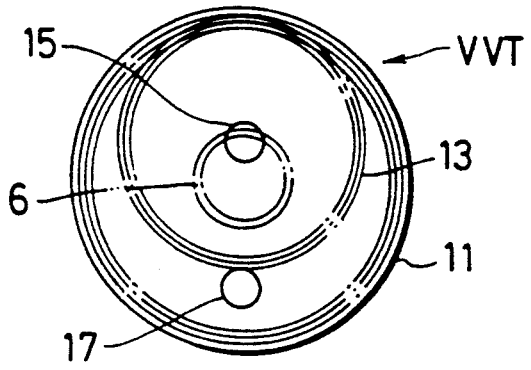
FIG. 4 is a schematic representation showing the relationship of an inner teethed gear disposed in a power transmitting member with a gear member.

The cam pulley 11 is provided at an inner circumference of its pulley section 11c with an inner gear 11d. A covering member 13 to be secured on the side of the engine body is provided with a bearing section 13a that in turn is disposed so as to rotatably support a gear member 14 having a diameter smaller than the outer diameter of the pulley section 11c of the cam pulley 11, as shown in FIG. 4. The gear member 10 is always in mesh with the inner gear 11d and is rotatably driven with the rotation of the cam pulley 11. This arrangement allows a rotation of the gear member 10 at a speed faster than the cam pulley 11. Further, the bearing section 13a working as the rotational center of the gear member 14 is eccentric from the axial line of the drive cam shaft 6.

The gear member 14 is disposed in the position close to and facing the side surface of the interconnection member 12, and its axial end is arranged so as to define and delimit a first hydraulic pressure chamber 15 in association with the bearing section 13a of the covering member 13. Further, the gear member 14 is allowed to move in the axial direction (to the left in FIG. 3) and to abut with and to be pressed toward the interconnection member 12 when hydraulic pressure is fed to the first hydraulic pressure chamber 15. On the other hand, when the hydraulic pressure is released from the first hydraulic pressure chamber 15, then the connection of the gear member 14 with the interconnection member 12 is released.

Further, the covering member 13 has a piston 16 arranged so as to be slidable and to define and delimit a second hydraulic pressure cmember 17. The piston 16 is moved axially in proportion to the hydraulic pressure fed to the second hydraulic pressure cmember 17, thereby allowing the piston 16 to abut with the interconnection member 12 and to be pressed toward it. This arrangement constitutes a means for decelerating or suspending the rotation of the interconnection member 12.

A description will then be made of the action of the valve-shift-timing control system according to the present invention.

Figure 7:
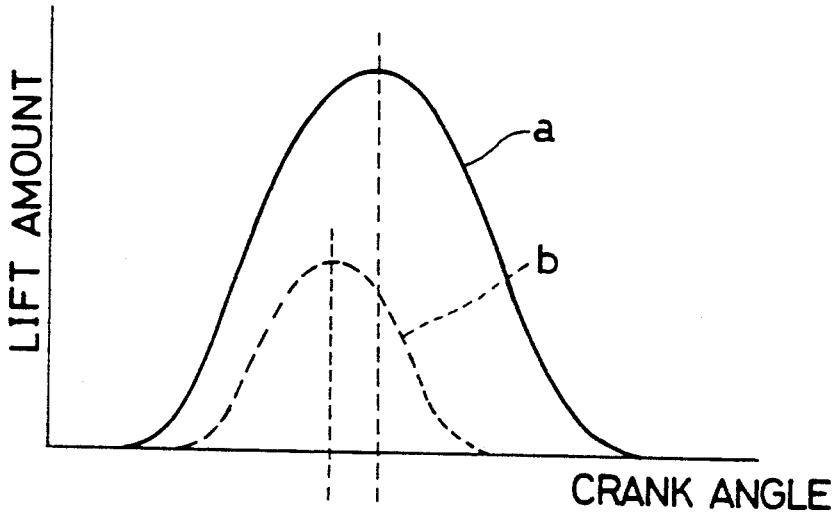
FIG. 7 is a characteristic diagram showing an example of a valve shift timing achieved by the present invention.

When the swingable cam 3 is brought into the position as indicated by reference symbol e in FIG. 1, the valve-shift-timing control system takes the status as shown in FIGS. 2(*a*) and 3(*a*). At this time, the drive cam shaft 6 and the rotatable cam 5 are transferred to the left to its maximal limit, and this is the state in which a valve lift amount becomes its maximal value. In other words, this is the state in which the valve lift amount and the valve lift angle are controlled to become large enough to offer the valve lift characteristic a as shown in FIG. 7.

When the swingable cam 3 is located in the position as indicated by reference symbol e in FIG. 1, the swingable cam 3 exists in the state in which it is about to be lifted by the rotatable cam 5 immediately thereafter and the base end of the arc-shaped lift section 8b of the swingable cam 3 is in abutment with the upper surface of the lash adjuster 2.

When the swingable cam 3 is allowed to pivot about the cam shaft 4 in a clockwise direction in FIG. 1 by the pivotal movement of the rotatable cam 5 in a counterclockwise direction in FIG. 1, the lash adjuster 2 is caused to be depressed downward by the arc-shaped lift section 8b of the swingable cam 3, thereby gradually increasing a valve lift amount of the valve 1. Thereafter, the swingable cam 3 follows the pivotal movement of the rotatable cam 5 due to the action of the biasing means 7 after the valve 1 exceeds its maximal valve lift amount while returning in the counterclockwise direction in FIG. 1 and decreasing the valve lift amount of the valve 1. As the swingable cam 3 returns to the position in which the arc-shaped base section 8a of the swingable cam 3 comes into abutment with the upper surface of the lash adjuster 2, the valve 1 is closed.

On the other hand, when the swingable cam 3 is located in the position as indicated by reference symbol f in FIG. 1, the swingable cam 3 and the rotatable cam 5 are moved to the right to its maximal limit. This is the state in which the valve lift amount reaches its minimal value, as shown in FIGS. 2(*b*) and 3(*b*). In other words, the valve lift amount and the valve lift angle are so controlled as to become small enough to offer the valve lift characteristic b as shown in FIG. 7.

As a result, a region varies, in which the swingable cam 3 pivots or swings when the rotatable cam 5 pivots in a given amount. In other words, in the state in which the swingable cam 3 swings or pivots at the same amount, the rate at which and the amount in which the arc-shaped base section 8*a* of the cam surface 8 of the swingable cam 3 is brought into slidable contact with the upper surface of the lash adjuster 2 becomes greater when the rotatable cam 5 is transferred to the left to its maximal limit than when the rotatable cam 5 is transferred to the right to its maximal limit. On the contrary, the rate at which and the amount in which the arc-shaped lift section 8*b* of the cam surface 8 of the swingable cam 3 is brought into slidable contact with the upper surface of the lash adjuster 2 becomes smaller in proportion to an increase in the rate at which and the amount in which the arc-shaped base section 8*a* thereof is brought into slidable contact with the upper surface thereof becomes greater.

As is apparent from the positions e and f of the swingable cam 3 as shown in FIG. 1, the effective diameter of the rotatable cam 5 is decreased in this case, so that the swingable cam 3 is caused to relatively pivot in a counterclockwise direction by the biasing means 7 by the amount in which the effective diameter of the rotatable cam 5 is decreased, thereby changing the initial phase. As a result, the point of time at which the valve 1 starts opening becomes delayed compared with when the swingable cam 5 exists in the position e as shown in FIG. 1.

Figure 8:
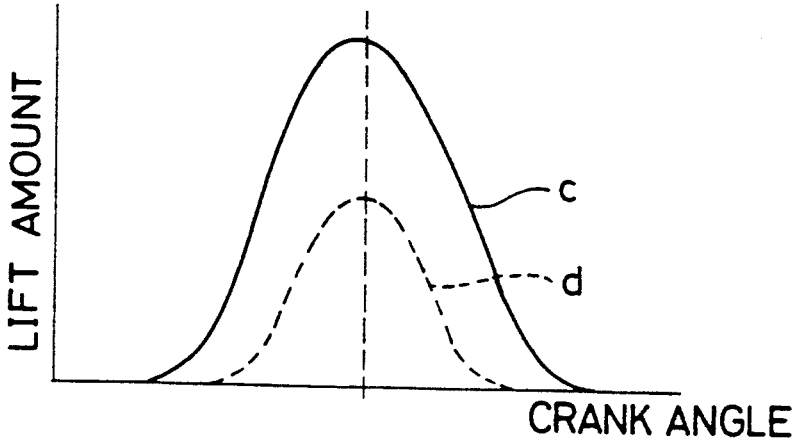
FIG. 8 is a characteristic diagram corresponding to FIG. 7 and showing a comparative example.

On the other hand, in conventional cases, the magnitudes of the valve lift amount and the valve lift angle of the valve 1 are adjusted merely by making invariable the crank angle at which the valve 1 is lifted to its maximal extent as shown in the valve lift characteristics as indicated by reference symbols c and d in FIG. 8. On the contrary, the valve-shift-timing control system according to the present invention further allows a relative movement of the cam shaft 6 in the axial direction to thereby change the rotational phase of the cam shaft 6 relative to the cam pulley 11. In other words, the magnitudes of the valve lift amount and the valve lift angle are adjusted, too, while adjusting the crank angle at which the valve 1 is lifted to its maximal extent as shown in the valve lift characteristics as indicated by reference symbols a and b in FIG. 7.

A description will now be made of the operation of the valve-shift-timing variable mechanism VVT.

When the cam shaft 6 is transferred from the position in which it is transferred to its maximal extent to the left as shown in FIG. 2(*a*) to the position in which it is transferred to its maximal extent to the right as shown in FIG. 2(*b*), that is, when the valve lift characteristic is changed from the status as indicated by reference symbol a in FIG. 7 to the status as indicated by reference symbol b in FIG. 7, the hydraulic pressure is fed to the first hydraulic pressure chamber 15 and the gear member 14 is transferred in the axial direction in proportion to the hydraulic pressure, thereby pressing the gear member 14 so as to abut with the interconnection member 12 and connecting the gear member 14 with the interconnection member 12. As a consequence, the interconnection member 12 that usually rotates at a speed equal to the cam pulley 11 and the cam shaft 6 starts rotating at the same speed as the gear member 14 because it is connected with the gear member 14 that rotates at a speed higher than the cam pulley 11 and the cam shaft 6. Hence, there causes a difference in rotation between the interconnection member 12 and the cam shaft 6 and this differential rotation causes the drive cam shaft 6 to move to the right to its maximal extent, a drive cam shaft having the square thread section 10*a* in mesh with a male thread section 12*a* of the interconnection member 12. As the drive cam shaft 6 is caused to move to the right to its maximal extent, the projections 11*b* of the cam pulley 11 engaged with the respective spline grooves 10*b* of the drive cam shaft 6 are transferred relatively to the left in parallel to the axial direction and along the spline grooves 10*b* thereof, thereby changing the rotational phase of the drive cam shaft 6 relative to the cam pulley 11. After the drive cam shaft 6 has been transferred to the right to its maximal extent, the hydraulic pressure to be fed to the first hydraulic pressure chamber 15 is released to thereby release the connection of the gear member 14 with the interconnection member 12. Even after the connection of the gear member 14 with the interconnection member 12 has been released, the status of the drive cam shaft 6 in which it was transferred to the right to its maximal extent is held by abrasion force of the projections 11*b* of the cam pulley 11 relative to the spline grooves 10 of the drive cam shaft 6.

On the other hand, when the cam shaft 6 is transferred from the position in which it is transferred to its maximal extent to the right to the position in which it is transferred to its maximal extent to the left, that is, when the valve lift characteristic is changed from the status as indicated by reference symbol b in FIG. 7 to the status as indicated by reference symbol a in FIG. 7, the hydraulic pressure is fed to the second hydraulic pressure chamber and the piston 16 is transferred in the axial direction in proportion to the hydraulic pressure, thereby pressing the interconnection member 12 so as to abut with the interconnection member 12 and decelerating or suspending the rotation of the interconnection member 12. As a consequence, the interconnection member 12 rotating at the speed equal to the cam pulley 11 and the drive cam shaft 6 is pressed toward the piston 16 and abuts therewith, thereby decelerating or suspending the rotation of the interconnection member 12. As a result, the drive cam shaft 6 is caused to rotate at a lower speed. Hence, there causes a difference in rotation between the interconnection member 12 and the drive cam shaft 6 and this differential rotation causes the drive cam shaft 6 having the square thread section 10*a* in mesh with the male teeth section 12*a* of the interconnection member 12 to move to the left to its maximal extent. As the drive cam shaft 6 is caused to move to the left to its maximal extent, the projections 11*b* of the cam pulley 11 engaged with the respective spline grooves 10*b* of the drive cam shaft 6 are transferred relatively to the right in parallel to the axial direction and along the spline grooves 10*b* thereof, thereby changing the rotational phase of the drive cam shaft 6 relative to the cam pulley 11. After the drive cam shaft 6 has been transferred to the left to its maximal extent, the supply of the hydraulic pressure to the second hydraulic pressure chamber 17 is suspended to thereby release the status in which the rotation of the gear member 14 is decelerated or suspended. Even after the decelerated or suspended status or position of the gear member 14 has been released, the status of the drive cam shaft 6 in which it was transferred to the left to its maximal extent is held by abrasion force of the projections 11*b* of the cam pulley 11 relative to the spline grooves 10 of the drive cam shaft 6.

The arrangements as described hereinabove can offer various functions to the valve-shift-timing control system according to the present invention. More specifically, the valve-shift-timing control system is provided with the function of adjusting the valve lift angle of the valve and the valve lift amount thereof as well by making invariable the crank angle at which the valve is lifted to its maximal extent as well as with the function of adjusting the relationship of the cam profile of the rotatable cam with the shape of the surface of the swingable cam on which the swingable cam is brought directly or indirectly into slidable contact with the intake valve or the exhaust valve. Further, it is provided the rotational phase changing means for making the rotational phase of the rotatable cam relative to the crank shaft variable with the relative axial movement of the rotatable cam at a part or a portion other than the swingable cam, thereby allowing the rotational phase changing means to achieve the function of adjusting the crank angle at which the valve is lifted to its maximal extent. Hence, this arrangement can allow a simple structure and configuration of the swingable cam, improve the limit of rotation of the engine, adjust the crank angle, at which the valve reaches its maximal valve lift amount, through the rotational phase changing means, and adjust the valve lift angle as well as the valve lift amount of the valve. In addition, the valve-shift-timing control system according to the present invention can improve the extent of freedom in setting the valve lift characteristics.

Further, the rotational phase changing means of the valve-shift-timing control system according to the present invention does not require any additional drive means for making the relative rotational phase variable because the engagement means for engaging the drive cam shaft with the power transmitting section so arranged as to be associated operatively with the crank shaft by taking advantage of the axial transfer of the rotatable cam shaft to be driven by the transfer means. This arrangement can make the structure and the configuration of the valve-shift-timing variable mechanism more compact and simplified.

It can further be noted as a matter of course that the engine demonstrates the characteristic a as shown in FIG. 7 when it rotates at a high speed and at a high load, while it demonstrates the characteristic b as shown in FIG. 7 when it rotates at a low speed and a low load.

As is apparent from FIGS. 3(*a*) and 3(*b*), the valve-shift-timing variable mechanism VVT can be made compact in structure by taking advantage of the gear member 14 so arranged as to be rotatable by the combination of the interconnection member 12 with the cam pulley 11 as the power transmitting member. In particular, the structure of the valve-shift-timing variable mechanism VVT can be made more compact by arranging the interconnection member 12 and the gear member 14 in a small space extending in the axial direction of the cam shaft and disposed between the covering member 13 and the cam pulley 11. A flange-shaped section is disposed extending radially outwardly from the boss section 12*a* of the interconnection member 12, while a flange-shaped section is disposed extending from the boss section 11*a* of the cam pulley 11 that is so disposed as to follow the flange-shaped portion of the interconnection member 12 from outside. This flange section constitutes a covering member on the side opposite to the covering member 13.

Now, a description will be made of the second embodiment of the valve-shift-timing control system according to the present invention with reference to FIGS. 9 to 14.

In FIGS. 9 to 14, the same and equal elements are provided with the same reference numerals and symbols as in the first embodiment of the valve-shift-timing control system as shown in FIGS. 1 to 8 and a duplicate description of the same and equal elements will be omitted for brevity of explanation.

Figure 9:
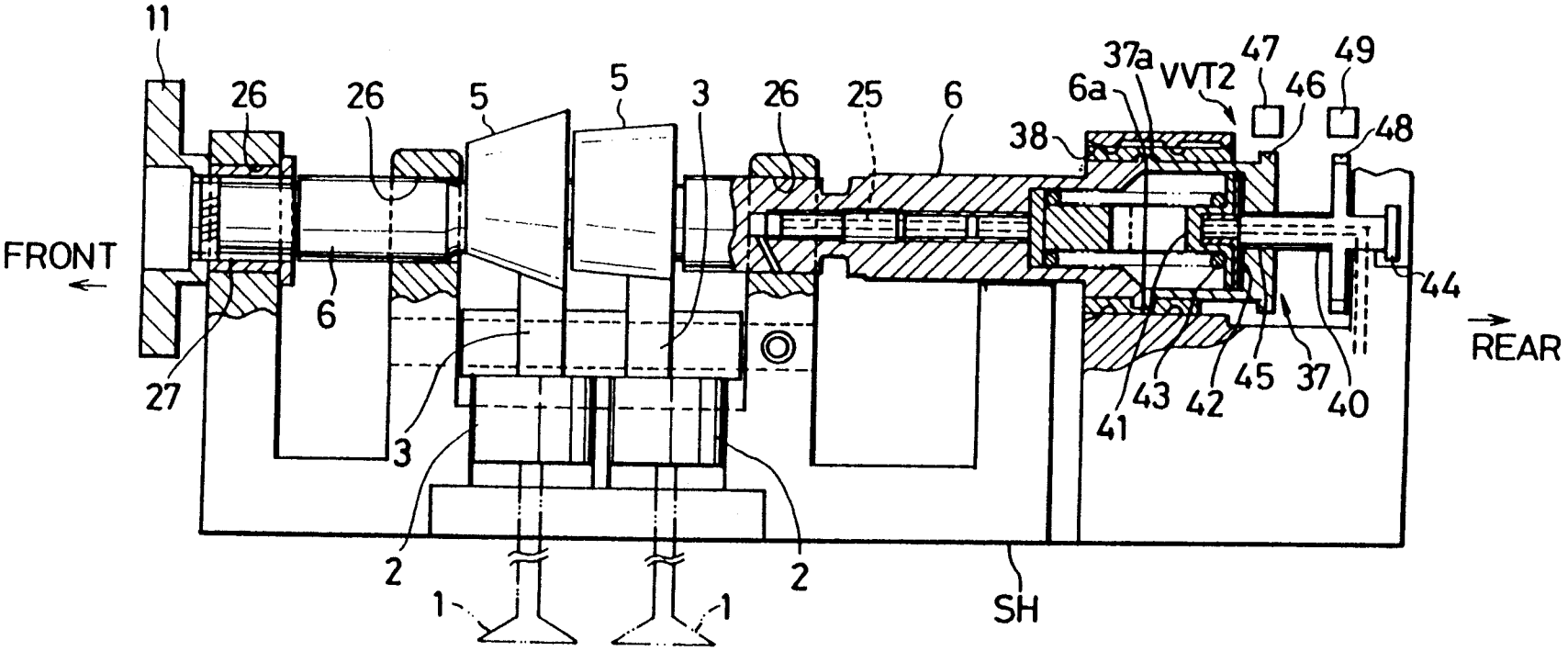
FIG. 9 is a sectional side view showing a second embodiment of the valve-shift-timing control system according to the present invention.
Figure 10:
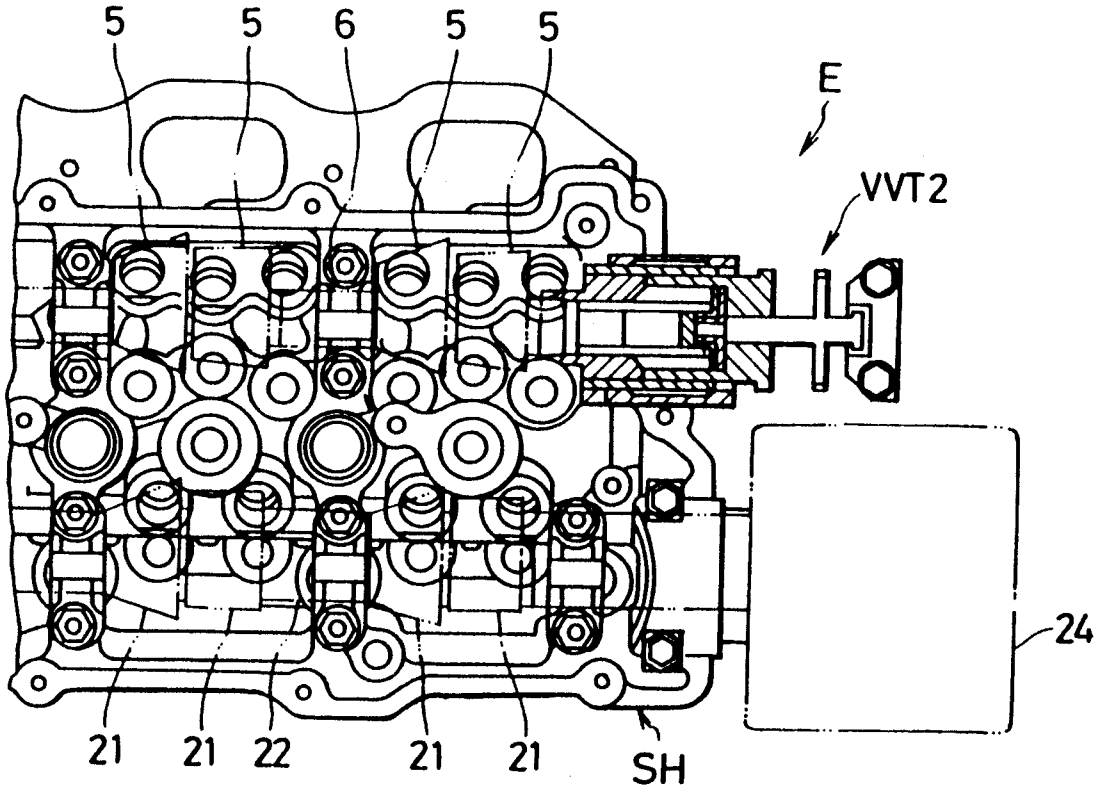
FIG. 10 is a partially sectional plan view showing an essential portion of FIG. 9.

In FIGS. 9 and 10, a cam shaft for an exhaust valve is referred to as reference numeral 22 and the exhaust valve is referred to as reference numeral 21. Further, reference numeral 24 denotes a distributer, reference numeral 25 denotes a lubricant path formed in the cam shaft 6 for the intake valve, and reference numeral 26 denotes a bearing section for holding the cam shaft arranged in the cylinder head SH.

The feature of the valve-shift-timing control system according to the second embodiment of the present invention resides in the structure that the rotational phase changing means is arranged at a one end portion of the cam shaft 6 as shown at the left side in FIG. 1, that a transfer means VVT2 for transferring the cam shaft 6, that is, the rotatable cam 5, in the axial direction in which the cam shaft extends, is disposed at the other end side of the cam shaft 6, and that the transfer means VVT2 has the structure and the configuration different from those of the transfer means for the valve-shift-timing control system in the first embodiment of the present invention.

In the second embodiment of the valve-shift-timing control system of the present invention, the rotational phase changing means is configured such that the cam pulley 11 is held at the one end side of the cam shaft 6 so as to be rotatable yet invariable in the axial direction of the cam shaft with respect to the bearing section 26. The cam pulley 11 is engaged with the cam shaft 6 through a helical spline engagement section 27.

Then, a detailed description will be made of the transfer means VVT2 disposed at the other end side of the cam shaft 6. In the description which follows, the left side in FIG. 9 is called "front" or a related word and the right side in FIG. 9 is called "rear" or a related word, for brevity of explanation.

The transfer means VVT2 has a first rotatable member 37 engaged with and pressed toward the rear end portion of the cam shaft 6 so as to be rotatable integrally with the cam shaft 6. An engagement section 6*a* formed at the rear end portion of the cam shaft 6 is so arranged as to abut directly with an engagement section 37*a* formed at the front end side of the first rotatable member 37, and the engagement section 6*a* of the cam shaft 6 is engaged with the engagement section 37*a* of the first rotatable member 37 at an appropriate extent of pressure through a connection member 38 in a generally cylindrical shape. This arrangement can basically allow the first rotatable member 37 to rotate integrally with the cam shaft 6; however, should the rotation of the first rotatable member 37 be restricted or suspended, the engagement section 37*a* of the first rotatable member 37 is caused to slide separately from the engagement section 6*a* of the cam shaft 6, whereby the first rotatable member 37 is caused to rotate separately from the cam shaft 6. Further, the cam shaft 6 and the first rotatable member 37 are arranged so as to be movable integrally by the action of the connection member 38 in the longitudinal direction of the body (in the axial direction in which the cam shaft 6 extends). In other words, as the first rotatable member 37 moves in the longitudinal direction of the body, the cam shaft 6 is allowed to move in the longitudinal direction thereof, too.

Further, the transfer means VVT2 is provided with a second rotatable member 40 so arranged as to be rotatably engaged integrally with the cam shaft 6 under pressure. More specifically, the cam shaft 6 is provided with a first engagement member 41 and the second rotatable member 40 is provided with a second engagement member 42, and the first engagement member 41 is engaged with the second engagement member under pressure, thereby allowing the cam shaft 6 to be rotated integrally with the second rotatable member 40. When the rotation of the second rotatable member 40 is restricted or suspended, however, the first and second engagement members 41 and 42 are caused to slide, thereby failing to rotate the second rotatable member 40 integrally with the cam shaft 6.

The first engagement member 41 is of a discrete body separate from the cam shaft 6, and a coil spring 43 is interposed between the first engagement member 41 and the rear end surface of the cam shaft 6 so as to bias in a direction in which the first engagement member 41 parts from the cam shaft 6. Hence, the first engagement member 41 is allowed to normally rotate integrally with the cam shaft 6, but it can be displaced in a free fashion in resistance to the biasing force applied in the longitudinal direction of the body from the coil spring 43. On the other hand, the second engagement member 42 is secured to the second rotatable member 40. As the coil spring 43 is interposed between the first engagement member 41 and the cam shaft 6, the second rotatable member 40 and the cam shaft 6 are allowed to be relatively displaced in the longitudinal direction (in the direction in which the axial line of the cam shaft 6 extends). However, the second rotatable member 40 has an engagement section 44 disposed at its rear end portion, and the longitudinal displacement of the second rotatable member 40 is restricted by the cylinder head SH. Hence, the second rotatably member 40 fails to displace in the longitudinal direction and only the cam shaft 6 is allowed to be displaced longitudinally. This arrangement causes the cam shaft 6 to be displaced longitudinally relative to the second rotatable member 40.

Furthermore, the first rotatable member 37 is in mesh with the second rotatable member 40 at an engagement section 45. Although not shown in detail in the drawings, a female thread section formed in the inner circumferential surface of a hole disposed in an axially central section of the first rotatable member 37 in a generally columnar form is so arranged as to be in mesh with a male thread section formed in the outer circumferential surface of the second rotatable member 40 in a generally columnar form, and this arrangement allows an engagement of the first rotatable member 37 with the second rotatable member 40. Hence, when a difference in rotational phase is caused to occur between the first and second rotatable members 37 and 40, both of the rotatable member 37 and the rotatable member 40 are caused to displace relatively in the longitudinal direction.

The first rotatable member 37 has a first engagement member 46 that in turn is provided with a first stopper 47 which is so arranged as to engage with the first engagement member 46 to thereby suspend the rotation of the first rotatable member 37. Likewise, the second rotatable member 40 has a second engagement member 48 that in turn is provided with a second stopper 49 which is so arranged as to engage with the second engagement member 48 to thereby suspend the rotation of the second rotatable member 40.

When the rotation of the first rotatable member 37 is suspended by the first stopper 47, the first rotatable member 37 is caused to fail to rotate integrally with the cam shaft 6 while the second rotatable member 40 is allowed to rotate integrally with the cam shaft 6. This causes a difference in a rotational phase between the first and second rotatable members 37 and 40 and the first and second rotatable members 37 and 40 are displaced so as to part from each other. However, as the longitudinal displacement of the second rotatable member 40 is restricted, the first rotatable member 37 is moved forward and, as a result, the cam shaft 6 is moved forward, too. In this case, the intake valve 1 is opened or closed at a given valve shift timing and in a given valve lift amount, which correspond to the cam face having the larger diameter, in the manner as described hereinabove.

On the other hand, when the rotation of the second rotatable member 40 is restricted by the second stopper 49, the second rotatable member 40 is caused to fail to rotate integrally with the cam shaft 6 while the first rotatable member 37 is allowed to rotate integrally with the cam shaft 6. This arrangement causes a difference in a rotational phase between the first and second rotatable members 37 and 40, and both of the first and second rotatable members 37 and 40 are relatively displaced in the direction in which they approach to each other in the longitudinal direction. Consequently, the first rotatable member 37 is transferred rearward and the cam shaft 6 is transferred rearward, too. In this case, the intake valve 1 is opened or closed at a given valve shift timing and in a given valve lift amount, which correspond to the cam face having the smaller diameter, in the manner as described hereinabove.

Then, a description will be made of a hydraulic drive mechanism S for driving and controlling the first and second stoppers 47 and 49.

Figure 11:
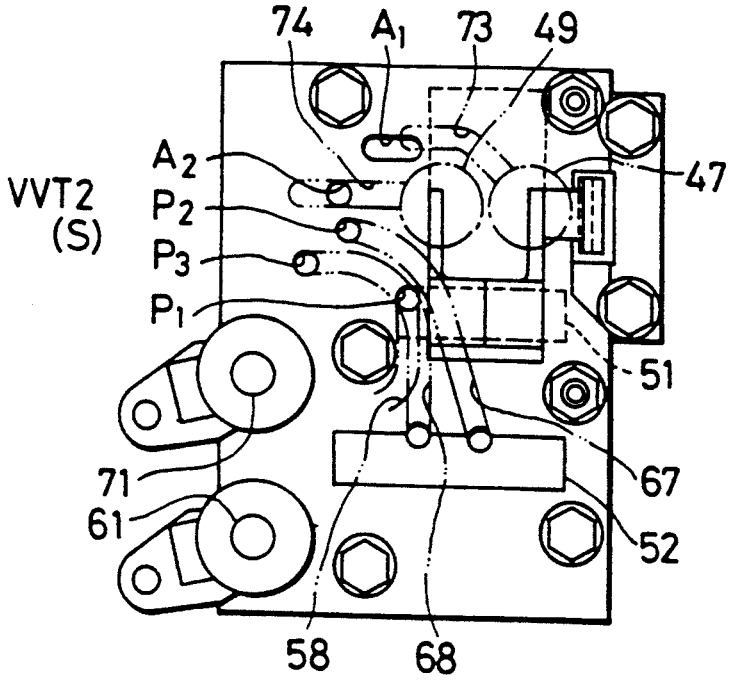
FIG. 11 is a plan view showing a hydraulic pressure system for changing the valve shift timing as illustrated in FIG. 8.
Figure 12:
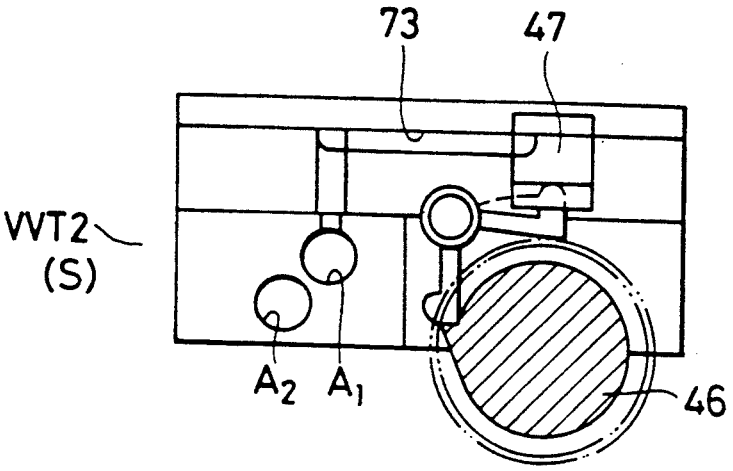
FIG. 12 is a front view showing the hydraulic pressure system as illustrated in FIG. 11, when viewed from the axial direction in which the cam shaft extends.
Figure 13:
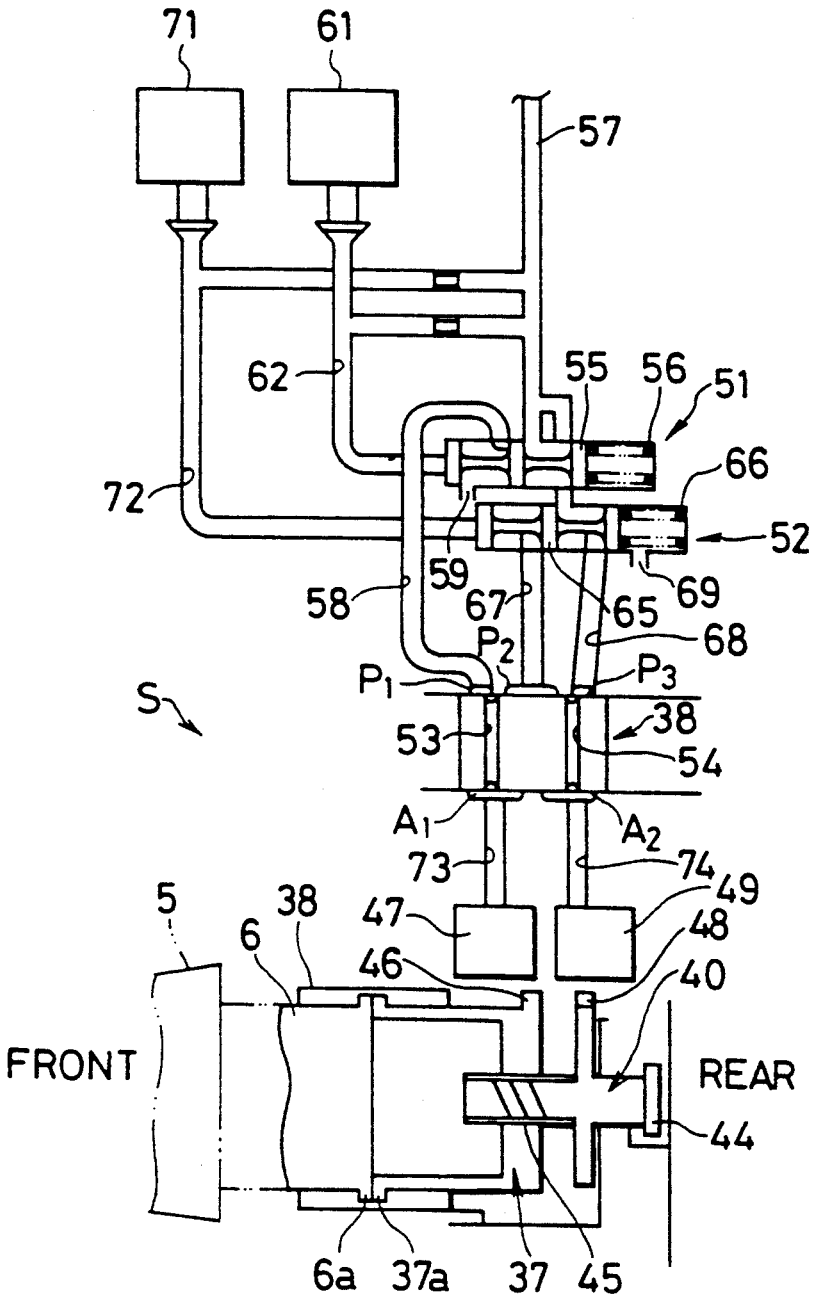
FIG. 13 is a hydraulic pressure control diagram showing a hydraulic pressure control system as illustrated in FIG. 11.

As shown in FIGS. 11 to 13, the first and second stoppers 47 and 49 are driven and controlled with the drive mechanism S. When the hydraulic pressure is applied, the rotation of the first and second rotatable members 37 and 40 is suspended and the hydraulic pressure to be applied to the first and second stoppers 47 and 49 is controlled by first and second control valves 51 and 52 as well as the connection member 38 having first and second groove sections 53 and 54.

The first control valve 51 is composed of a hydraulic control valve having a spool 55 and a return spring 56, and it is so arranged as to shift the status of the hydraulic pressure between the status in which the hydraulic pressure fed from a hydraulic pressure supply path 57 is generated into a first oil path 58 and the status in which the hydraulic pressure in the first oil path 58 is drained into a drain port 59. More specifically, when a first solenoid 61 is turned on, the hydraulic pressure in a first control oil path 62 is released and the spool 55 is displaced into its front end position by the return spring 56, as shown in FIG. 13, thereby communicating the first oil path 58 with the drain port 59. On the other hand, when the first solenoid 61 is turned off, the hydraulic pressure is applied to the first control oil path 62 and the spool 55 is displaced in its rear end position by the hydraulic pressure, thereby communicating the first oil path 58 with the hydraulic pressure supply path 57.

The second control valve 52 is composed of a hydraulic control valve having a spool 65 and a return spring 66 and it is so arranged as to shift the status of the hydraulic pressure between the position in which the hydraulic pressure fed from the hydraulic pressure supply path 57 is generated into a second oil path 67 and the hydraulic pressure in a third oil path 68 is drained into the drain port 69 and the position in which the hydraulic pressure fed from the hydraulic pressure supply path 57 is generated into the third oil path 68. More specifically, when a second solenoid 71 is turned on, the hydraulic pressure in a second control oil path 72 is released and the spool 65 is displaced in its front end position by the return spring 66, as shown in FIG. 13, thereby communicating the third oil path 68 with the hydraulic pressure supply path 57. On the other hand, when the second solenoid 71 is turned off, then the hydraulic pressure is applied to the second control oil path 72 and the spool 65 is displaced in its rear end position by the hydraulic pressure, thereby communicating the second oil path 67 with the hydraulic pressure supply path 57 and the third oil path 68 with the drain port 69.

The connection member 38 is arranged connecting the cam shaft 6 with the first rotatable member 37 in the manner as described hereinabove; hence, the cam shaft 6 is transferred integrally with the first rotatable member 37 in the longitudinal direction and the longitudinal movement of the cam shaft 6 integral with the first rotatable member 37 changes the positions of the first and second groove sections 53 and 54 in the longitudinal direction, thereby consequently changing the state of communication of a first input port P1, a second input port P2 and a third input port P3 with a first output port A1 and a second output port A2 and controlling the supply of the hydraulic pressure to and withdrawal thereof from the first and second stoppers 47 and 49. The first, second and third input ports P1, P2 and P3 are connected with the first, second and third oil paths 58, 67 and 68, while the first and second output ports A1 and A2 are connected the first or second stopper 47 or 49 through first or second hydraulic pressure output path 73 or 74.

Figure 14A:
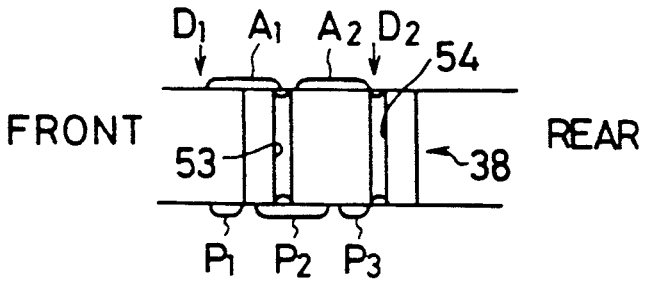
FIGS. 14(*a*), 14(*b*) and 14(*c*) are each a working status of control valves, out of the control valves as illustrated in FIG. 13, to be operated in accordance with displacement in the axial direction in which the cam shaft extends.
Figure 14B:
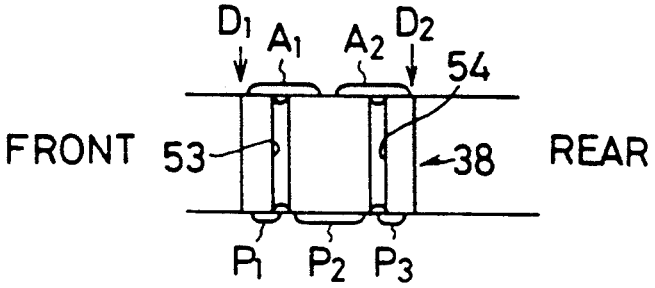
Figure 14C:
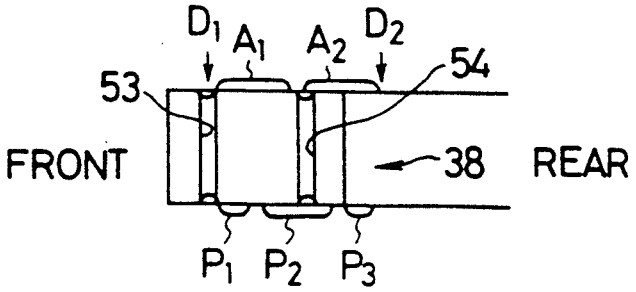

More specifically, when the connection member 38 (the cam shaft 6) is located in a given rearward position as shown in FIG. 14(*a*), the first groove section 53 communicates the second input port P2 with the first output port A1, while the second groove section 54 does not communicate any input port with any output port. In FIGS. 14(*a*), 14(*b*) and 14(*c*), reference symbols D1 and D2 denote the left end portion and the right end portion, respectively, when the connection member 38 (the cam shaft 6) is located in its neutral position (the original position for transfer).

When the connection member 38 (the cam shaft 6) is located in its neutral position as shown in FIG. 14(*b*), the first groove section 53 communicates the first input port P1 with the first output port A1, while the second groove section 54 communicates the third input port P3 with the second output port A2.

Further, when the connection member 38 (the cam shaft 6) is located in a given forward position, the second groove section 54 communicates the second input port P2 with the second output port A2 while the first groove section 53 fails to communicate any input port with any output port.

Now, a description will be made of the procedure of controlling a shift of the positions of the cam shaft 6, that is, a shift of the valve shift timing for opening or closing the intake valve 1 or a valve lift amount of the intake valve 1.

When the cam shaft 6 is in a stationary state in the given rearward position, the first and second solenoids 61 and 71 are turned on. In this state, the hydraulic pressure is supplied only to the third input port P3 (the third oil path 68). Further, in this state, as the connection member 38 is located in the rear end position, the first groove section 53 communicates the second input port P2 with the first output port A1, as shown in FIG. 14(*a*). Hence, no hydraulic pressure is generated from the first and second output ports A1 and A2, and the first and second stoppers 47 and 49 fails to restrict the rotation of the first and second rotatable members 37 and 40.

In order to transfer the cam shaft 6 forward from this state, the second solenoid 71 is turned off while the first solenoid 61 is being turned on. At this time, the spool 65 of the second control valve 52 is located in its rear end position and the hydraulic pressure is supplied to the second input port P2 (the second oil path 67) only. In this case, the connection member 38 is located in its rear end position; hence, the first groove section 53 communicates the second input port P2 with the first output port A1 as shown in FIG. 14(*a*), thereby generating the hydraulic pressure from the first output port A1 and suspending the rotation of the first rotatable member 37 by supplying the hydraulic pressure to the first stopper 47. As a result, the cam shaft 6 is transferred forward. When the cam shaft 6 moves forward and the connection member 38 reaches its neutral position, the first groove section 53 fails to communicate the second input port P2 with the first output port A1 as shown in FIG. 14(*b*), whereby no hydraulic pressure is generated from the first output port A1 and the first stopper 47 fails to restrict the rotation of the first rotatable member 37 and suspends the forward movement of the cam shaft 6.

This state is held when the position (the valve shift timing or the valve lift amount) of the cam shaft 6 is set to its neutral position.

Then, the first solenoid 61 is turned off while the second solenoid 71 is being turned off. This brings the spool 55 of the first control valve 51 into its rear end position, and the hydraulic pressure is fed to the first input port P1 (the first oil path 58). To the second input port P2 is continually fed the hydraulic pressure. In this case, the connection member 38 is located in its neutral position and, as a result, the first groove section 53 communicates the first input port P1 with the first output port A1 as shown in FIG. 14(*b*), thereby generating the hydraulic pressure from the first output port A1 and supplying the hydraulic pressure to the first stopper 47 to thereby suspend the rotation of the first rotatable member 37. Hence, the cam shaft 6 is allowed to move further forward. When the connection member 38 then reaches its given forward position, the second solenoid 71 is turned on. At this time, as the first groove section 53 fails to communicate the first input port P1 with the first output port A1, no hydraulic pressure is generated from the first output port A1 and the first stopper 47 does not restrict the rotation of the first rotatable member 37, thereby suspending the forward movement of the cam shaft 6. Then, the cam shaft 6 is brought into the given forward position.

In order to transfer the cam shaft 6 rearward from its given forward position, the first solenoid 61 is turned on while the second solenoid 71 is turned off. At this time, the hydraulic pressure is supplied to the second input port P2 (the second oil path 67) only. In this case, the connection member 38 is located in its forward position and the second groove section 54 communicates the second input port P2 with the second output port A2 as shown in FIG. 14(*c*), thereby supplying the hydraulic pressure from the second output port A2 to the second stopper 49 and suspending the rotation of the second rotatable member 40. Hence, the cam shaft is allowed to move rearward. When the cam shaft 6 is moved rearward and the connection member 38 reaches its neutral position, the second groove section 54 fails to communicate the second input port P2 with the second output port A2 as shown in FIG. 14(*b*), thereby failing to generating the hydraulic pressure from the second output port A2, allowing the second stopper 49 to fail to restrict the rotation of the second rotatable member 40 and suspending the rearward movement of the cam shaft 6.

Then, the second solenoid 71 is turned on while the first solenoid 61 is being turned on. This allows the hydraulic pressure to be fed to the third input port P3 (the third oil path 68). At this time, the connection member 38 is located in the neutral position and the second groove section 54 communicates the third input port P3 with the second output port A2 as shown in FIG. 14(*b*), thereby discharging the hydraulic pressure from the second output port A2 and feeding the hydraulic pressure to the second stopper 49 to thereby suspend the rotation of the second rotatable member 40. Hence, the cam shaft 6 is allowed to move further rearward. When the connection member 38 reaches its given rearward position, the second groove section 54 fails to communicate the third input port P3 with the second output port A2 as shown in FIG. 14(*a*), thereby failing to discharge the hydraulic pressure from the second output port A2 and to restrict the rotation of the second rotatable member 40 to thereby suspend the rearward movement of the cam shaft 6. Then, the cam shaft 6 is allowed to be located in the given rearward position.

As described hereinabove, this embodiment of the present invention can transfer the cam shaft in its axial direction merely by mechanically restricting or suspending either of the first or second rotatable member; hence, the valve-shift-timing control system according to the present invention can be made compact in size and simple in structure.

Figure 15:
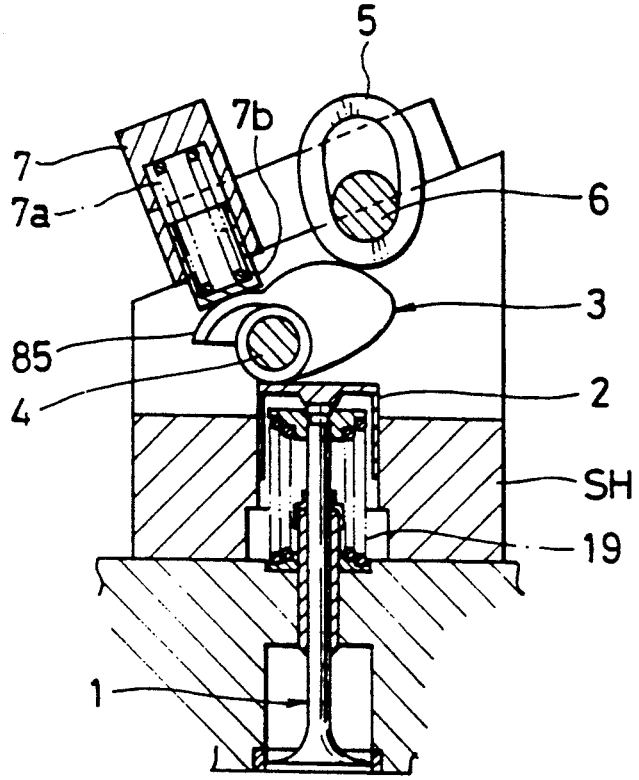
FIG. 15 is a partially sectional front view showing a third embodiment of the valve-shift-timing control system according to the present invention, corresponding to FIG. 1.
Figure 16:
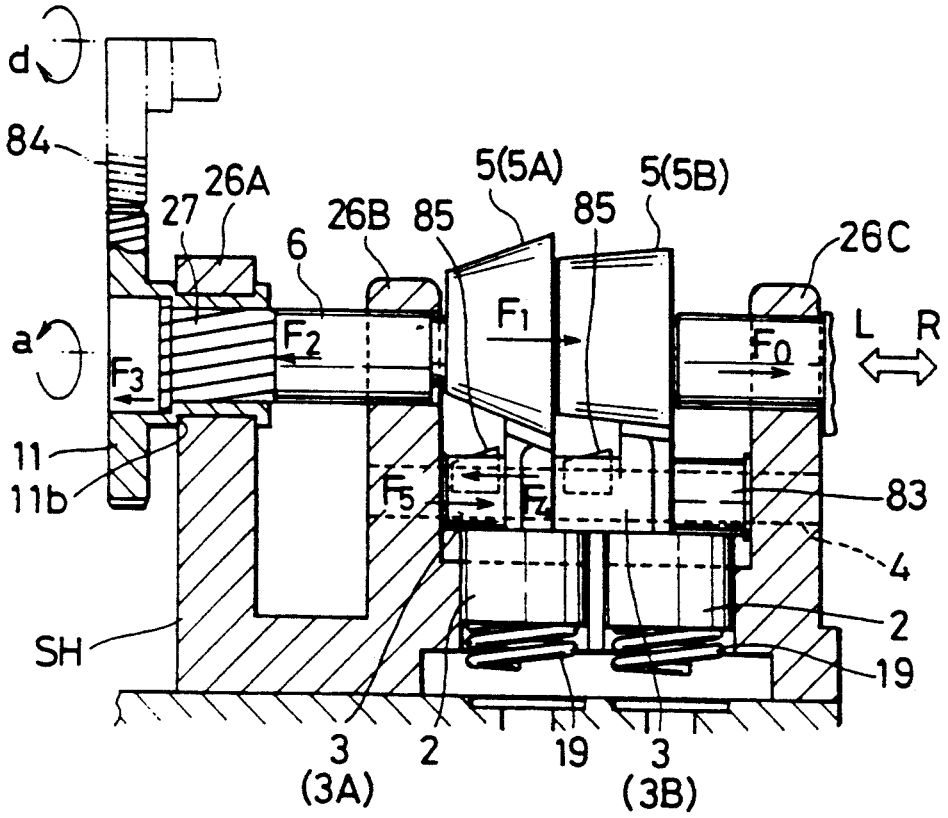
FIG. 16 is a partially sectional side view showing an essential portion of FIG. 15.
Figure 17:
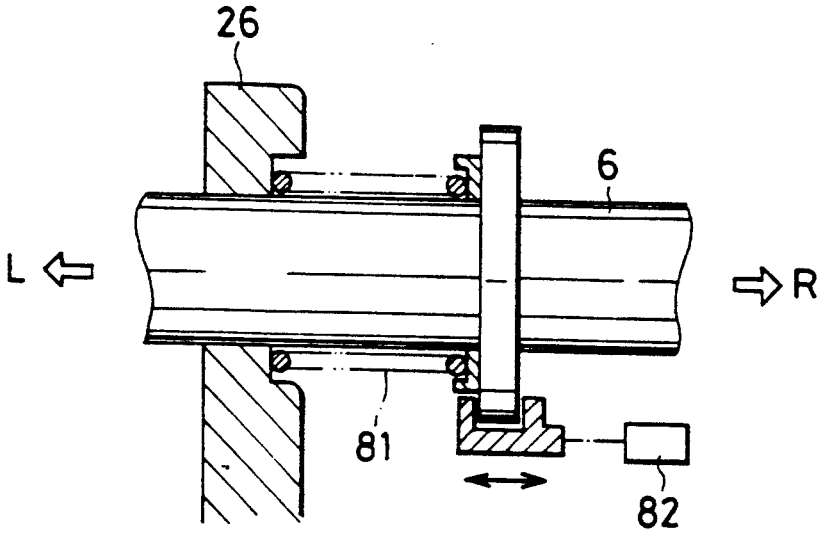
FIG. 17 is a sectional, abridged side view showing an example of the portion of the cam shaft to be transferred in the axial direction in which the cam shaft extends.

FIGS. 15 to 17 are directed to the third embodiment of the valve-shift-timing control system according to the present invention, in which the same and similar elements and parts are provided with the same reference numerals and symbols as the first and second embodiments as described hereinabove and a description of those elements and parts will be omitted for avoidance of duplicate explanation.

As shown in FIG. 17, the transfer means comprises a spring 81 for biasing the cam shaft 6 to the right R in FIG. 16 and a hydraulic actuator 82 for driving the cam shaft 6 to the left L in resistance to the spring 81. When the cam shaft 6 is going to move to the right R beyond a given position or over a given distance, an end surface of a rotatable cam 5B is restricted by abutment with a supporting section 26C. On the other hand, when the cam shaft 6 is going to move to the left L beyond a given position or over a given distance, an end surface of a rotatable cam 5A is restricted by abutment with a supporting section 26B.

Further, swingable cams 3A and 3B are disposed so as to be movable in an axial direction of a swingable shaft 4. When the swingable cam 3B is going to move to the right R beyond a given position or over a given distance, the right movement of the swingable cam 3B is restricted by abutment of its end shift with a supporting section 26C through a spacer 83. On the other hand, when the swingable cam 3A is going to move to the left L beyond a given position or over a given distance, the right movement of the swingable cam 3A is restricted by abutment of its end shift with a supporting section 26B.

The rotational phase changing means for the valve-shift-timing control system according to the third embodiment of the present invention has the cam pulley 11 held to the cylinder head SH so as to be rotatable yet undisplaceable in the axial direction of the cam shaft and engaged with the cam shaft 6 through a helical spline 27, in the same manner as the rotational phase changing means for the valve-shift-timing control system according to the second embodiment of the present invention. The cam pulley 11 is comprised of a helical gear that is in mesh with a helical gear 84 for driving the cam shaft for the exhaust valve, and the rotation of the output shaft of the engine is transmitted to the cam pulley (helical gear) 11 through the helical gear 84.

The rotatable cams 5A and 5B as well as the swingable cams 3A and 3B have each a tapered cam surface so as to come into slidable engagement with each of the tapered cam surface of the rotatable cam 5A and 5B with the tapered cam surface of each of the swingable cams 3A and 3B. When each of the intake valves 1 and 1 is opened or closed by the rotatable cam 5A or 5B through the swingable cam 3A or 3B, the spring force of each of the valve springs 19 to be transmitted to each of the intake valves 1 and 1 acts upon the section in which the tapered cam surface of each of the rotatable cam 5A and 5B abuts slidably with the tapered cam surface of each of the swingable cams 3A and 3B. Should the spring force of each valve spring 19 act in a given amount as contact pressure thereupon, a thrust force F1 is caused to occur to the direction as indicated by the arrow R as a force component acting in the axial direction in which the cam shaft extends. The thrust force F1 is not always constant and it may vary with the valve lift amount. The thrust force F1 becomes largest at the time when the valve lift amount is large, that is, at the time of a rotational phase in which each swingable cam 3 is in slidable contact with a higher cam portion of each rotatable cam 5 or at the time when each swingable cam 3 is in slidable contact with the larger diameter side of each rotatable cam 5.

If the such large thrust force F1 act in the same direction as a combined force with the biasing force of the biasing means and such a combined force act upon the cam shaft 6 to thereby transfer the cam shaft 6 from the position as shown in FIG. 16 to the right direction as indicated by the arrow R, the end surface of the rotatable cam 5B at its transferring end is caused to collide with the end surface of the supporting section 26C at a relatively large impact force, thereby presenting the disadvantages that abrasion of the supporting section 26C may be caused to accelerate and unpleasant noises may be caused.

It can be noted herein that the rotational force of the cam pulley (helical gear) 11 causes a thrust force F2 between the cam shaft 6 and the cam pulley (helical gear) 11, engaged with the cam shaft 6 in a helical spline manner, as a result of the inclination of the helical spline 27. Hence, in this embodiment, the thrust force F2 is allowed to act in the direction opposite to the direction in which the thrust force F1 acts, thereby making smaller a combined thrust force F0 acting as part of driving force for transferring the cam shaft 6 in the right direction as indicated by the arrow R. Hence, the direction of the inclination of the helical spline 27 is so set as for the thrust force F2 to act in the direction opposite to the direction in which the thrust force F1 is applied.

As described hereinabove, the arrangement of the valve-shift-timing control system according to the present invention can suppress abrasion of the end surface of the supporting section 26C or noises from occurring by making smaller the impact strength to be caused upon an impact of the end surface of the rotatable cam 5B with the end surface of the supporting section 26C at the time when the cam shaft 6 transfers to the right direction as indicated by the arrow R. This arrangement can eventually improve durability or reliability of the power valve system as a whole. Further, when the combined thrust force F0 acting upon the cam shaft 6 is made smaller in the manner as described hereinabove, the operating force required to transfer the cam shaft 6 to the left direction as indicated by the arrow L by a means for transferring the cam shaft can be made smaller, thereby making the means for transferring the cam shaft smaller in size and compact in structure as well as improving responsiveness to operation at the time when a lift of the valve changes and consequently achieving a higher extent of engine performance.

On the other hand, if the thrust force F2 is caused to occur at the spline engagement section where the cam shaft 6 is spline-engaged with the cam pulley (helical gear) 11, a relatively large amount of contact pressure occurs as a reaction against the thrust force F2 at the section where the one end surface **11*b* of the cam pulley (helical gear) 11 is in contact with the one end surface of the supporting section 26A. This is considered to accelerate the abrasion of the end surface of the supporting section 26A. Hence, in this embodiment, the teeth of the cam pulley (helical gear) 11 is so arranged as to be inclined to set a thrust force F3 caused by the driving force from the helical gear 84 on the exhaust side to occur and act in the direction identical to the direction in which the thrust force F2 acts. This arrangement can help the thrust force F3 reduce the extent of contact pressure acting upon the contact surface between the cam pulley (helical gear) 11 and the supporting section 26A as a reaction against the thrust force F2, thereby suppressing the end surface of the supporting section 26A** from abrading and, as a consequence, improving durability.

Furthermore, as a reaction against the thrust force F1 that occurs on the cam shaft 6, a thrust force F4 is caused to occur on the side of each swingable cam 3 in the direction in which the swingable cam 3 is transferred toward the side of the supporting section 26B. As a result, a large extent of contact pressure is caused to occur on the contact surfaces between the one end surface of the swingable cam 3A and the end surface of the supporting section 26B and between the facing end surfaces of the swingable cams 3A and 3B, thereby causing to accelerate abrasion on the contact surfaces. Hence, in this embodiment, each of the swingable cams 3A and 3B is provided with a receiver section 85 for receiving the biasing force, which acts as a supporting section for supporting the biasing force from the spring **7*a* working as the biasing means 7. Further, the receiver section 85 is so arranged as to be inclined in the direction opposite to the direction in which the cam surface of each of the swingable cams 3A and 3B inclines, thereby allowing the biasing force from the biasing means 7 entered into the receiver section 85** to cause a thrust force F5 to occur in the direction opposite to the direction in which the thrust force F4 acts. This arrangement can help the thrust force F5 reduce part of the thrust force F4 acting as the contact force, thereby resulting in a decrease in the contact force and consequently suppressing the contact surfaces from abrading.

Figure 18:
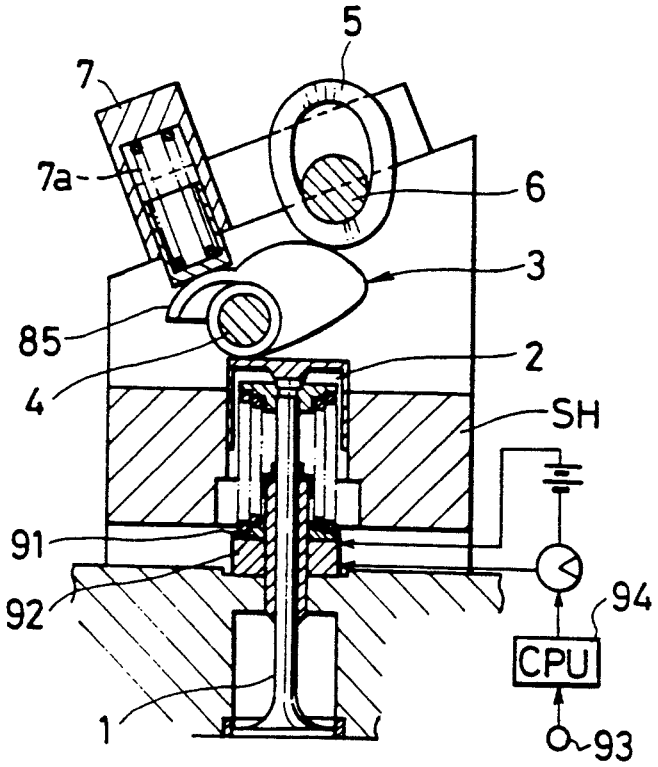
FIG. 18 is a partially sectional front view showing a fourth embodiment of the valve-shift-timing control system according to the present invention, corresponding to FIG. 15.

FIG. 18 is directed to the fourth embodiment of the valve-shift-timing control system according to the present invention, in which the same and similar elements and parts are provided with the same reference numerals and symbols as the other embodiments and a description of those elements and parts will be omitted from the description that follows, for brevity of explanation. It can be noted herein that the valve-shift-timing control system in this embodiment has substantially the same structure as the valve-shift-timing control systems according to the other embodiments of the present invention. Hence, the valve-shift-timing control system of this embodiment according to the present invention can achieve substantially the same effects as the valve-shift-timing control systems according to the other embodiments of the present invention. In addition, the valve-shift-timing control system in this embodiment can offer a more improved effect of removing the influence of the thrust force Fl. Specifically, as shown in FIG. 18, a piezoelectric element 92 having the property of varying its laminate thickness in accordance with the applied voltage is interposed between the cylinder head SH and a spring bearing 91 for the valve spring 19 so as to allow the voltage applied to the piezoelectric element 92 to vary in proportion to the number of revolutions of the engine. More specifically, in the region in which the engine rotates at a high speed, the high voltage is applied and the thickness of the piezoelectric element is made thicker, thereby enhancing the spring force of the valve spring 19. On the other hand, in the region in which the engine rotates at a low speed, the low voltage is applied to make the thickness of the piezoelectric element thinner, thereby reducing the spring force of the valve spring 19. The control over the voltage is made by outputting a control signal from a control unit 94 in response to an output signal from a sensor 93 for sensing the number of revolutions of the engine.

The arrangement for a variation in the spring force of the valve spring 19 with the number of revolutions of the engine is based on the concept that the thrust force F1 so set as to be smaller by setting the spring force of the valve spring to become smaller at the time of the low speed of the engine is considered to be useful for measures for competing with abrasion. This is no necessity of making the spring force larger when the engine is rotating at the low speed because the intake valve 1 does not cause a jump or a bounce so much at that time, while the spring force is required to be made larger in order to suppress such a jump or a bounce from occurring at the time when the engine is rotating at the high speed because the intake valve 1 causes such a jump or a bounce at a high frequency.

It is to be understood that the foregoing text and drawings relate to embodiments of the present invention given by way of examples but not limitation. Various other embodiments and variations are possible within the spirit and scope of the present invention.

What is claimed is:

1. A system for controlling a valve-shift-timing of an engine, comprising:

a cam shaft arranged so as to be rotatably driven by an output shaft of the engine;

a swingable cam disposed so as to be swingable for lifting at least one of an intake valve and an exhaust valve in accordance with a pivotal movement of said swingable cam upon at least one of a direct and an indirect abutment with said at least one of said intake valve and said exhaust valve;

a rotatable cam disposed on said cam shaft so as to be rotatable integrally with said cam shaft and to move said swingable cam pivotally in accordance with rotation of said cam shaft;

a transfer means for transferring said rotatable cam in an axial direction in which said cam shaft extends; and a rotational phase changing means for changing a rotational phase of said rotatable cam relative to said output shaft in accordance with the movement of said rotatable cam by said transfer means;

wherein each of an abuttable surface of said swingable cam and an abuttable surface of said rotatable cam is of a shape tapered in the axial direction in which said cam shaft extends; and said rotatable phase changing means is disposed on a portion other than said swingable cam.

2. A valve-shift-timing control system as claimed in claim 1, wherein said rotational phase changing means is disposed in a position closer to said cam shaft than to said rotatable cam.

3. A valve-shift-timing control system as claimed in claim 1, wherein:

said rotatable cam is disposed so as to be unmovable relative to said cam shaft in an axial direction in which said cam shaft extends;

said cam shaft is held with a body of the engine so as to be movable in the axial direction in which said cam shaft extends; and said transfer means is arranged to transfer said rotatable cam in the axial direction of said cam shaft by axially transferring said cam shaft relative to the body of the engine.

4. A valve-shift-timing control system as claimed in claim 3, wherein:

said rotatable cam is further disposed so as to be unrotatable relative to said cam shaft; and said rotational phase changing means is disposed in a path for transmitting power in a position thereof located between said cam shaft and said output shaft of the engine.

5. A valve-shift-timing control system as claimed in claim 4, wherein:

said cam shaft is engaged with a power transmitting member of a rotary type for transmitting rotation of said output shaft of the engine to said cam shaft; and said rotational phase changing means is disposed in a position located between said cam shaft and said power transmitting member.

6. A valve-shift-timing control system as claimed in claim 5, wherein:

said power transmitting member is held with the body of the engine so as to be rotatable yet unmovable in the axial direction in which said cam shaft extends;

said power transmitting member is engaged with said cam shaft so as to be relatively movable and to change a rotational phase of said power transmitting member relative to said cam shaft in accordance with the relative movement; and the rotational phase of said power transmitting member relative to said cam shaft is changed on the basis of a relationship of engagement of said power transmitting member with said cam shaft when said cam shaft is moved or displaced in the axial direction of said cam shaft relative to said power transmitting member by said transfer means.

7. A valve-shift-timing control system as claimed in claim 6, wherein the engagement of said power transmitting member with said cam shaft is effected through a helical spline formed at one of said power transmitting member and said cam shaft and a projection formed at the other of said power transmitting member and said cam shaft so as to be engaged with said helical spline.

8. A valve-shift-timing control system as claimed in claim 7, wherein:

said cam shaft has a threaded section disposed in a position close to said power transmitting member; and said transfer means has an interconnection member and a shift means;

wherein said interconnection member is held with the body of the engine so as to be unmovable in the axial direction in which said cam shaft extends and said interconnection member is in mesh with said threaded section; and said shift means is so adapted as to shift a position of said interconnection member between a first position in which said interconnection member is rotated at a speed higher than the number of rotation of said power transmitting member and a second position in which said interconnection member is rotated at a speed lower than the number of rotation of said power transmitting member.

9. A valve-shift-timing control system as claimed in claim 8, wherein:

said power transmitting member is provided with an inner teethed gear having a teeth section disposed in an inner circumference thereof; and said shift means has a gear member, a first actuator and a second actuator;

wherein said gear member is in mesh with said inner teethed gear of said power transmitting member at a normal time and has a diameter smaller than a diameter of said inner teethed gear, which is so disposed as to come into contact with or to part from said interconnection member;

wherein said first actuator is so adapted as to have said gear member abut with and press toward said interconnection member; and wherein said second actuator is so adapted as to apply braking force to said interconnection member.

10. A valve-shift-timing control system as claimed in claim 9, further comprising:

a covering member fixed to the body of the engine so as to hold said first actuator and said second actuator as well as to hold said gear member rotatably;

wherein said power transmitting member, said interconnection member, said gear member, and said covering member are disposed in a row in this order sequentially from inside to outside in the axial direction in which said cam shaft extends;

a space having a narrow size is disposed between said power transmitting member and said covering member in the axial direction in which said cam shaft extends;

said inner teethed gear is disposed in said power transmitting member so as to face said space;

said interconnection member and said gear member are disposed in said space; and a pressing force which is applied to a section at which said first actuator is connected with said second actuator is so set as to be directed toward inside from outside in the axial direction in which the cam shaft extend.

11. A valve-shift-timing control system as claimed in claim 10, wherein:

said helical spline is provided in said cam shaft and said projection is provided on said power transmitting member so as to be engaged with said helical spline;

said interconnection member has a first boss section and a first plate section, wherein said first boss section is so disposed as to be in mesh with a thread section formed in said cam shaft and wherein said first plate section in a flange-shaped form extends outwardly in a radial direction from said first boss section; and said power transmitting member has a second boss section and a second plate section, wherein said second boss section having a projection disposed so as to be rotatably engaged with said first boss section of said interconnection member and to be in mesh with said helical spline and wherein said second plate section in a flange-shaped form extends in a direction parallel to or along said first plate section of said interconnection member.

12. A valve-shift-timing control system as claimed in claim 11, wherein said helical spline is provided on the thread section formed in the cam shaft.

13. A valve-shift-timing control system as claimed in claim 4, further comprising:

a power transmitting member of a rotary type for transmitting rotation of an output shaft of the engine to said cam shaft;

wherein said rotational phase changing means is engaged with a one end portion of said cam shaft in a state that said power transmitting member is held with the body of the engine so as to be rotatable yet unmovable in the axial direction in which said cam shaft extends;

wherein said rotational phase changing means has a helical spline formed at a one end portion of said cam shaft and a projection formed at said power transmitting member so as to be engaged with said helical spline; and wherein said transfer means comprises:

a thread section formed at a one end portion of said cam shaft;

an interconnection member held with the body of the engine so as to be rotatable yet unmovable in the axial direction in which said cam shaft extends and so as to be engaged with said thread section;

a high-speed rotating member disposed so as to be rotatably driven by said output shaft of the engine at a speed higher than said power transmitting member and so as to come into contact with or to part from said interconnection member;

a first actuator so arranged as to press said high-speed rotating member toward and upon said interconnection member; and a second actuator so arranged as to apply braking force to said interconnection member.

14. A valve-shift-timing control system as claimed in claim 13, wherein:

said thread section is provided with said helical spline;

said power transmitting member is provided with said inner teethed gear; and said high-speed rotating member is comprised of a gear member in mesh with said inner teethed gear.

15. A valve-shift-timing control system as claimed in claim 4, wherein:

said transfer means comprises:

a first rotatable member engaged with and pressed toward an end surface of said cam shaft so as to be rotatable integrally with said cam shaft and disposed so as to be movable together with said cam shaft in the axial direction in which said cam shaft extends in a state in which said first rotatable member is engaged with and pressed toward the end surface of said cam shaft;

a second rotatable member held with the body of the engine so as to be rotatable yet unmovable in the axial direction in which said cam shaft extends and disposed so as to be rotatable integrally with said cam shaft by pressed engagement with the end surface of said cam shaft;

a thread means for engaging said first rotatable member with said second rotatable member and for transferring said first rotatable member relative to said second rotatable member, that is, relative to the body of the engine, in the axial direction in which said cam shaft extends, when said first rotatable member is rotated relative to said second rotatable member;

a first restriction means for restricting the rotation of said first rotatable member in resistance to the pressed engagement between said cam shaft and said first rotatable member; and a second restriction means for restricting the rotation of said second rotatable member in resistance to the pressed engagement between said cam shaft and said second rotatable member.

16. A valve-shift-timing control system as claimed in claim 15, further comprising a connection member for connecting said cam shaft with said first rotatable member so as to make said cam shaft move integrally with said first rotatable member in the axial direction in which said cam shaft extends, while keeping a state in which the pressed engagement between said cam shaft and said first rotatable member is made.

17. A valve-shift-timing control system as claimed in claim 15, wherein said cam shaft abuts with said first rotatable member in a pressed state through a coil spring.

18. A valve-shift-timing control system as claimed in claim 17, wherein:

said thread means comprises a female thread section formed in said first rotatable member and a male thread section formed in said second rotatable member so as to be in mesh with said female thread section;

said first rotatable member has a cylindrical portion which is integral with said female thread section and which abuts with an end surface of said cam shaft in a pressed state;

said male thread section formed in said second rotatable member extends into said cylindrical portion of said first rotatable member; and said coil spring is disposed in the said cylindrical portion of said first rotatable member and seated on said male thread section extending in said cylindrical portion thereof.

19. A valve-shift-timing control system as claimed in claim 15, further comprising:

a power transmitting member of a rotary type for transmitting rotation of an output shaft of the engine to said cam shaft;

wherein said rotational phase changing means has said power transmitting member engaged with an one end portion of said cam shaft in a state in which said power transmitting member is held with the body of the engine so as to be rotatable yet unmovable in the axial direction in which said cam shaft extends; and wherein said rotational phase changing means has a helical spline formed at a one end portion of said cam shaft and a projection formed in said power transmitting member so as to be engaged with said helical spline.

20. A valve-shift-timing control system as claimed in claim 19, wherein:

said first rotatable member, second rotatable member, first restriction means and second restriction means are disposed at the side of the one end portion of said cam shaft; and said power transmitting member is disposed on the side of an other end portion of said cam shaft.

21. A valve-shift-timing control system as claimed in claim 15, wherein:

said first and second restriction means are each comprised of a hydraulic actuator;

a first control valve is disposed for supplying and discharging hydraulic pressure to and from said first restriction means;

a second control valve is disposed for supplying and discharging hydraulic pressure to and from said second restriction means; and a third control valve is disposed for allowing hydraulic pressure to be supplied and discharged so as to transfer said cam shaft only toward a stroke end located in the axial direction in which said cam shaft extends, prior to an operation of each of said first and second control valves, when said first rotatable member, that is, said cam shaft is located at an opposite stroke end in the axial direction in which said cam shaft extends.

22. A valve-shift-timing control system as claimed in claim 21, wherein:

said first and second control valves are each of an electromagnetically operative type; and said third control valve is of a mechanically operative type having a spool disposed so as to be displaced in accordance with the axial movement of said cam shaft.

23. A valve-shift-timing control system as claimed in claim 22, further comprising:

a connection member for connecting said cam shaft with said first rotatable member so as to move said cam shaft integrally with said first rotatable member in the axial direction in which said cam shaft extends, while keeping a state in which said cam shaft abuts with said first rotatable member in a pressed state.

24. A valve-shift-timing control system as claimed in claim 4, further comprising:

a valve spring disposed in said intake valve or said exhaust valve so as to bias said intake valve or said exhaust valve toward a direction in which said intake valve or said exhaust valve is closed; and a power transmitting member of a rotary type for transmitting rotation of said output shaft of the engine; and wherein said rotational phase changing means has said power transmitting member engaged with an one end portion of said cam shaft in a state in which said power transmitting member is held with the body of the engine so as to be rotatable yet unmovable in the axial direction in which said cam shaft extends;

wherein said cam shaft is engaged with said power transmitting member through a helical spline;

wherein a first thrust force is caused to occur by a biasing force of said valve spring at a section in which said swingable cam abuts with said rotatable cam and said first thrust force acts in a first direction;

wherein a second thrust force is caused to occur by a rotational force of said power transmitting member at a section in which said helical spline is engaged and said second thrust force acts in a second direction; and wherein said helical spline is so arranged as to be inclined to set the direction in which said first direction in which said first thrust force acts is opposite to the second direction in which said second thrust force acts.

25. A valve-shift-timing control system as claimed in claim 24, wherein:

said power transmitting member is comprised of a first helical gear;

a second helical gear to be driven rotatably by said output shaft of the engine is in mesh with said first helical gear;

a third thrust force is caused to occur by a rotational force of said second helical gear in a third direction in which said third thrust force acts, at a section in which said first helical gear is in mesh with said second helical gear; and said third helical gear is so arranged as to be inclined to set said third direction to be identical to said second direction in which said second thrust force acts.

26. A valve-shift-timing control system as claimed in claim 24, further comprising:

a biasing means for biasing said swingable cam in a direction in which said swingable cam abuts with said rotatable cam;

wherein a surface of said swingable cam onto which the biasing force is applied and which receives the biasing force is so arranged as to be inclined in the axial direction in which said cam shaft extends;

a fourth thrust force is caused to occur at the inclined surface of said swingable cam in a fourth direction by the biasing force of said biasing means; and said surface of said swingable cam is so arranged so as to be inclined to set said fourth direction to be identical to said first direction in which said first thrust force acts.

27. A valve-shift-timing control system as claimed in claim 24, wherein:

said power transmitting member is comprised of a first helical gear;

a second helical gear to be driven rotatably by said output shaft of the engine is in mesh with said first helical gear;

a third thrust force is caused to occur by a rotational force of said second helical gear in a third direction in which said third thrust force acts, at a section in which said first helical gear is in mesh with said second helical gear;

said third helical gear is so arranged as to be inclined to set said third direction to be identical to said second direction in which said second thrust force acts;

a biasing means is further provided for biasing said swingable cam in a direction in which said swingable cam abuts with said rotatable cam;

wherein a surface of said swingable cam onto which the biasing force is applied and which receives the biasing force is so arranged as to be inclined in the axial direction in which said cam shaft extends;

a fourth thrust force is caused to occur at the inclined surface of said swingable cam in a fourth direction by the biasing force of said biasing means; and said surface of said swingable cam is so arranged so as to be inclined to set said fourth direction to be identical to said first direction in which said first thrust force acts.

28. A valve-shift-timing control system as claimed in claim 24, wherein:

said transfer means comprises a biasing means for biasing said cam shaft toward a one end portion side in the axial direction in which said cam shaft extends and an actuator for driving said cam shaft toward the other end portion side in the axial direction of said cam shaft in resistance to the biasing force from said biasing means for biasing said cam shaft; and a direction in which said biasing means biases said cam shaft is so set as to be identical to said first direction in which said first thrust force acts.

29. A valve-shift-timing control system as claimed in claim 24, wherein an end surface of said rotatable cam is brought into abutment with the body of the engine so as to restrict the displacement of said cam shaft when said cam shaft is going to move in a given position or beyond a given length in the axial direction in which said cam shaft extends.

30. A valve-shift-timing control system as claimed in claim 24, wherein:

said swingable cam is held with the body of the engine so as to be movable in the axial direction in which said cam shaft extends; and an end surface of said swingable cam is brought into abutment with the body of the engine so as to restrict the displacement of said swingable cam when said swingable cam is going to move in a given position or beyond a given length in the axial direction in which said cam shaft extends.

31. A valve-shift-timing control system as claimed in claim 24, wherein:

a seat of said valve spring is comprised of a piezoelectric element; and a control means is further provided for controlling a biasing force of said valve spring by controlling a voltage to be applied to said piezoelectric element in accordance with a running state of the engine and changing a thickness of said piezoelectric element.

32. A valve-shift-timing control system as claimed in claim 31, wherein:

said piezoelectric element is made thinner when the engine is rotating at a lower speed; and said piezoelectric element is made thicker when the engine is rotating at a higher speed.

* * * * *